US007266873B2

(12) United States Patent
Okajiima et al.

(10) Patent No.: US 7,266,873 B2
(45) Date of Patent: Sep. 11, 2007

(54) THROW-AWAY BURNISHING TOOL FOR OUTSIDE DIAMETER AND FOR INSIDE DIAMETER

(75) Inventors: Hideaki Okajiima, Uozu (JP); Tetsuya Suzuki, Uozu (JP); Hiroyasu Yamada, Uozu (JP)

(73) Assignee: Sugino Machine Limited, Toyama (JP)

( * ) Notice: Subject to any disclaimer, the term of this patent is extended or adjusted under 35 U.S.C. 154(b) by 170 days.

(21) Appl. No.: 11/264,226

(22) Filed: Nov. 1, 2005

(65) Prior Publication Data

US 2006/0144198 A1 Jul. 6, 2006

(30) Foreign Application Priority Data

Jan. 5, 2005 (JP) ..... 2005-000317

(51) Int. Cl.
*B21C 37/30* (2006.01)
*B24B 39/00* (2006.01)

(52) U.S. Cl. ..... 29/90; 407/1

(58) Field of Classification Search ..... 29/90.01; 407/1; 408/59
See application file for complete search history.

(56) References Cited

U.S. PATENT DOCUMENTS 3,115,704 A * 12/1963 Fawell ..... 29/566
3,835,517 A * 9/1974 Walters ..... 29/90.01
3,840,957 A * 10/1974 Koppelmann ..... 29/90.01
3,930,294 A * 1/1976 Kalen ..... 29/90.01
4,054,976 A * 10/1977 Ewald et al. ..... 29/90.01
4,118,846 A * 10/1978 Korte ..... 29/90.01
5,099,558 A * 3/1992 Wilson ..... 29/90.01
5,299,346 A * 4/1994 Kilgore et al. ..... 29/33 K
5,522,124 A * 6/1996 Depperman ..... 29/90.01
6,101,696 A * 8/2000 Carter ..... 29/90.01
6,106,370 A * 8/2000 Carter ..... 451/51
6,568,057 B2 * 5/2003 Okeda et al. ..... 29/90.01
6,580,266 B2 * 6/2003 Baumgartner et al. ..... 324/212
7,118,313 B2 * 10/2006 Grove et al. ..... 408/74
2002/0046451 A1 * 4/2002 Okeda et al. ..... 29/90.01
2002/0152597 A1 * 10/2002 Porter et al. ..... 29/90.01

OTHER PUBLICATIONS

IMS Burnishing Catalog, Japan-Jan. 5, 2005.

* cited by examiner

*Primary Examiner*—Willmon Fridie, Jr.
(74) *Attorney, Agent, or Firm*—Merchant & Gould P.C.

(57) ABSTRACT

A throw-away burnishing tool for an outside diameter includes: a tool holder having a rectilinear I-shaped portion and a protrusion portion; a hard material tip detachably attached to a tip holder; a holder pin connected to the tip holder and accommodated in the protrusion portion of the tool holder, the holder pin having an oblong aperture in the form of a through-hole extending in a direction substantially perpendicular to an axis of the holder pin; an urging means internally inserted into the holder pin and urging the holder pin; an urging force adjustment means for adjusting an urging force generated by the urging means; and a parallel pin supported at both ends by the tool holder and passing through the oblong aperture, wherein the parallel pin guides a movement of the holder pin along the oblong aperture.

4 Claims, 4 Drawing Sheets

THROW-AWAY BURNISHING TOOL FOR OUTSIDE DIAMETER AND FOR INSIDE DIAMETER

BACKGROUND OF THE INVENTION

The present invention relates to a throw-away burnishing tool for burnishing an outside diameter of a workpiece and a throw-away burnishing tool for burnishing an inside diameter of a workpiece.

Conventionally, for burnishing the surface of hardened steel having a hardness of HRC 40 or more and when burnishing the surface of a stainless steel material, burnishing tools using diamond in place of rollers are known.

FIGS. 4A through 4C show a conventional throw-away burnishing tool 30 using diamond, wherein FIG. 4A is a plan view, FIG. 4B is an enlarged plan view of an S-portion of FIG. 4A, and FIG. 4C is a sectional view along the line R-R of FIG. 4B. This kind of throw-away burnishing tool for an outside diameter is known; for example, from an IMS burnishing tool type BNN manufactured by IMS Co., Ltd. See IMS Burnishing Catalogue distributed by General distributor Nitmac.

Tool holders have various sizes, and the maximum throw-away burnishing tool 30 is 25 mm×25 mm in cross section (width×height) and 160 mm in total length.

As shown in FIG. 4B, at a front-end portion of a tool holder 35, an attachment seat 35*a* for a tip holder 36 is provided, and to this attachment seat 35*a*, the tip holder 36 is fixed by a bolt 35*b*. This bolt 35*b* is inclined at 30°, and an attachment seat 36*e* for a tip holder 36 shown in FIG. 4C is also inclined at 30°.

In addition, a hole 36*a* inclined at 45° is bored in a left front-end portion of the tip holder 36, and a diamond tip 37 is inserted into this hole 36*a* and is fixed by a screw 36*c*. In addition, at a central portion of the tip holder 36, a roughly double-keyhole shaped groove 36*b* is formed, and by this groove 36*b*, only a section between a double-keyhole head portion and an outer circumferential surface 36*d* is integrally connected. In order to urge this tool holder 35 against the tip holder 36, elastic deformation of a connecting portion 36*g* is utilized.

As shown in FIG. 4C, the tip holder 36 is formed in a T-shape in a front view. The attachment seat 36*e* for the bolt 35*b* is inclined at approximately 30°, a notch is formed in a U-shape in a bolt through-hole 36*f*, and only by loosening the bolt 35*b*, the tip holder 36 can be replaced, and by tightening the same, the tip holder 36 is pressed against the shoulders of the attachment seat 35*a* and is fixed thereto.

In addition, as shown in FIG. 4B, an aspherically formed diamond 37*a* is embedded in a front-end portion of the diamond tip 37, and the diamond tip 37 is formed with clearance angles $\alpha$ and $\beta$ of 5° from its surface.

In addition, a height to the center of the diamond tip 37 is 25 mm, which is the same as the height of the tool holder 35, as shown in FIG. 4C.

However, since the conventional throw-away burnishing tool 30 for an outside diameter has employed an urging method by an elastic deformation of the connecting portion 36*g* provided at the tip holder 36, when a pressing force which the diamond tip 37 imparts to a workpiece is changed in magnitude, the diamond tip 37 is changed in posture. Therefore, there are several problems, such that the machining direction is not fixed, that the pressing force is not changed by changing an urging force during machining, that it is difficult to satisfy Hooke's law, namely, a linear proportional relationship between displacement and urging force, and that an accurate adjustment for the urging force is not made.

SUMMARY OF THE INVENTION

The present invention has been contrived to solve these problems, and it is an object of the invention to provide a throw-away burnishing tool, which can keep the posture of the hard material tip when the tip receives a pressing force, which can vary an urging force to change a pressing force of the tip during machining, and which can provide a linear relationship between displacement and urging force so as to enable an accurate adjustment of the urging force.

According to a first aspect of the present invention, there is provided a throw-away burnishing tool for an outside diameter including: a tool holder having a rectilinear I-shaped portion and a protrusion portion; a hard material tip detachably attached to a tip holder; a holder pin connected to the tip holder and accommodated in the protrusion portion of the tool holder, the holder pin having an oblong aperture in the form of a through-hole extending in a direction substantially perpendicular to an axis of the holder pin; an urging means internally inserted into the holder pin and urging the holder pin; an urging force adjustment means for adjusting an urging force generated by the urging means; and a parallel pin supported at both ends by the tool holder and passing through the oblong aperture, wherein the parallel pin guides a movement of the holder pin along the oblong aperture.

In the aforementioned throw-away burnishing tool, the I-shaped portion and the protrusion portion may be integral to each other to provide an L-shape profile of the tool holder.

Further, in the aforementioned throw-away burnishing tool, the hard material tip may be made of diamond or CBN.

According to the first aspect of the present invention, a hard material tip may be attached to an attachment seat of the tip holder, and the hard material tip may be of a throw-away type, so that replacement of the hard material tip can be facilitated and size of the hard material tip can be reduced. If the tip end of the hard material tip is semicircular, only one single hard material tip can be used for burnishing in many different directions, such as outer surface, end surface, inner surface (in a case of having a large diameter.

According to the first aspect of the present invention, the urging means, which urges the holder pin in the axial direction of the holder pin, is internally inserted into the holder pin, and the urging force adjustment means for adjusting the urging force generated by the urging means is provided. Therefore, even if the hard material tip receives a pressing force during machining or the pressing force is changed during machining, it is possible to keep the posture of the hard material tip unchanged. In addition, providing a mechanism for accurately adjusting the urging force makes it possible to facilitate a setting for various machining conditions.

Further, in one exemplary embodiment, since the tool holder is an L-shape profile having the rectilinear I-shaped portion and the protrusion portion, the urging force adjustment means which applies a force to the urging means to urge the holder pin can be provided at the protrusion portion off from the rectilinear I-shaped portion. This can allow the input portion of the urging force adjustment means to be rotated easily by means of a standard tool (hexagonal wrench) or the like, which can readily adjust the urging force.

Further, in one exemplary embodiment, since the hard material tip is made of diamond or CBN, even if burnishing the surface of a to-be-machined object such as hardened steel having a hardness of HRC 40 to 60, or a stainless steel material, burnishing is readily performed because of a difference in hardness.

According to a second aspect of the present invention, there is provided a throw-away burnishing tool for an inside diameter including: a cylindrical shank to be mounted on a processing machine; a tip holder received in the shank and rotatable around a rotating shaft by a workpiece pressing force; an attachment seat provided at a front-end portion of the tip holder; a throw-away type hard material tip detachably attached to the attachment seat; a pusher accommodated in the shank and having an end surface; an urging means provided at the end surface of the pusher and urging the pusher toward the tip holder in an axial direction of the shank; an urging force adjustment means for adjusting an urging force generated by the urging means; an urging force conversion means for transmitting the urging force to an enlarged diameter shaft of the tip holder such that a direction of the urging force is converted to a rotating direction of the enlarged diameter shaft, wherein a pressing force is imparted to a workpiece by a rotation of the tip holder in the rotation direction that is caused by the urging force.

According to the second aspect of the present invention, the throw-away burnishing tool for an inside diameter is provided with an attachment seat at the front-end portion of the tip holder and a hard material tip of a throw-away type which is detachably attached to the attachment seat, so that replacement of the hard material tip can be facilitated and size of the hard material tip can be reduced and further an interference during machining can be prevented. Further, the shank 11 excluding the tip holder can be commonly used as a roller burnishing tool, which can reduce the cost.

Other features and advantages of the present invention will be apparent from the following description.

BRIEF DESCRIPTION OF THE DRAWINGS

The aspects of the present invention will become more apparent by describing in detail illustrative, non-limiting embodiments thereof with reference to the accompanying drawings, in which:

FIGS. 1A trough 1C show a throw-away burnishing tool for an outside diameter according to a first embodiment of the present invention, in which FIG. 1A is a plan view.

FIGS. 2A and 2B are enlarged views of a front-end portion of the throw-away burnishing tool, in which FIG. 2A is an enlarged sectional view along the line B-B of FIG. 1B, and FIG. 2B is a sectional view along the line C-C of FIG. 2A;

FIGS. 3A and 3B show a tool holder of a throw-away burnishing tool for an inside diameter according to a second embodiment of the present invention, in which FIG. 3A is a sectional view, and FIG. 3B is a sectional view along the line D-D of FIG. 3A; and FIGS. 4A through C show a conventional throw-away burnishing tool, in which FIG. 4A is a plan view, FIG. 4B is an enlarged plan view of an S-portion of FIG. 4A, and FIG. 4C is a sectional view along the line R-R of FIG. 4A.

DETAILED DESCRIPTION OF THE INVENTION

FIRST EMBODIMENT

Hereinafter, a first embodiment of the present invention will be described in detail with reference to the drawings.

Figure 1A:
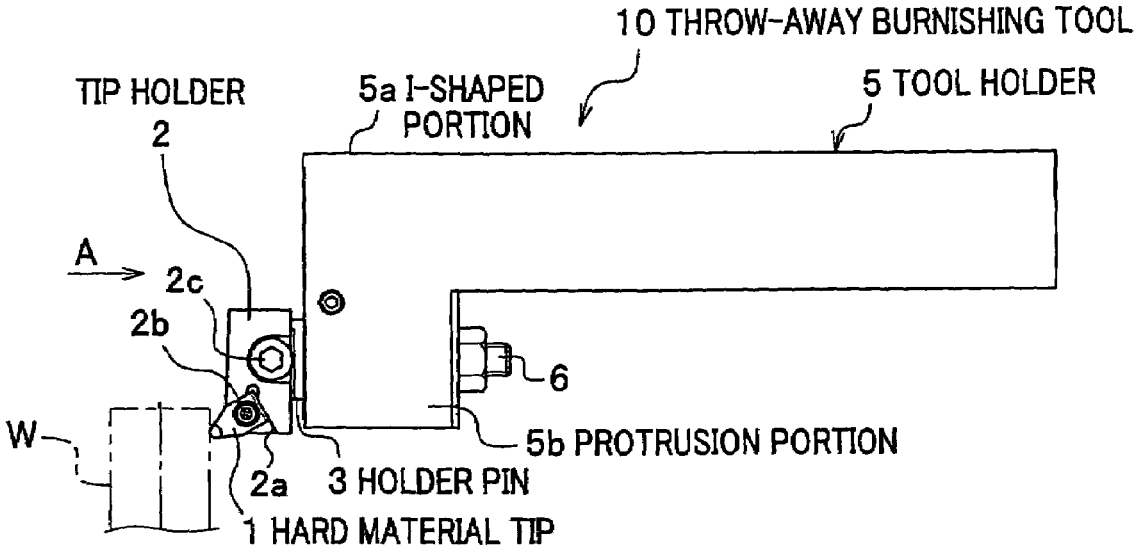
Figure 1B:
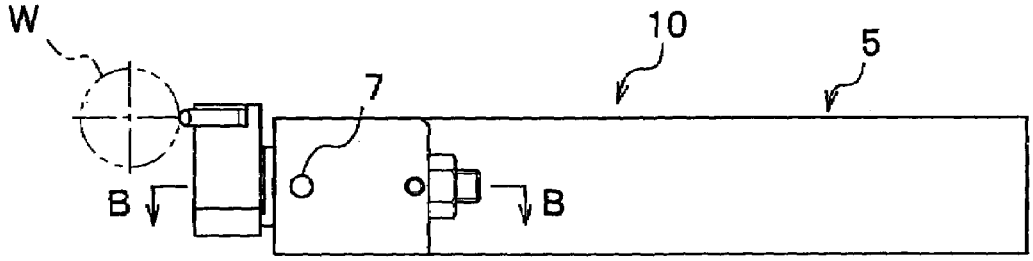
FIG. 1B is a front view.
Figure 1C:
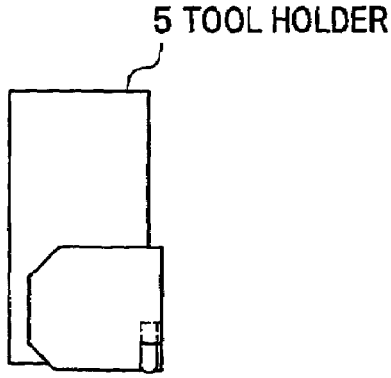
FIG. 1C is a view as seeing from the arrow A shown in FIG. 1A.

As shown in FIG. 1A, a throw-away burnishing tool 10 for an outside diameter includes a tool holder 5 having an I-shaped portion 5*a* and a protrusion portion 5*b* which are formed integral to each other to provide an L-shaped profile.

Figure 2A:
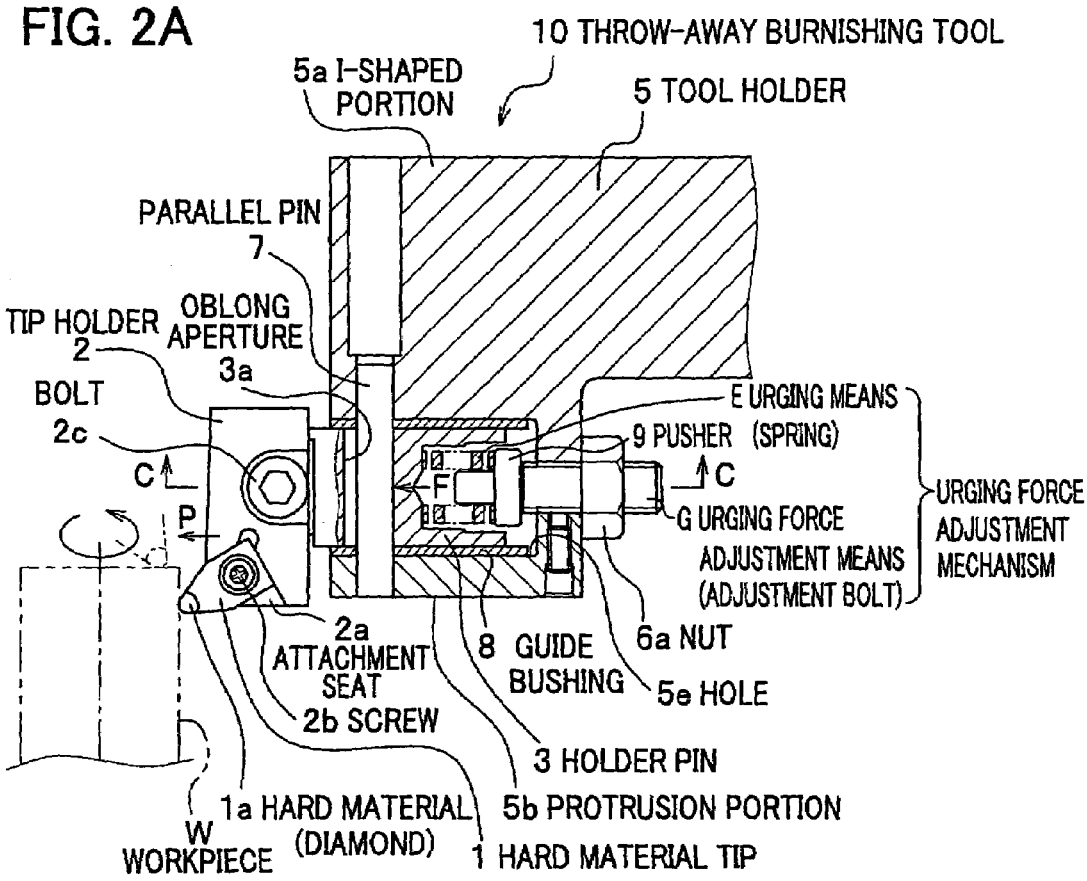
Figure 2B:
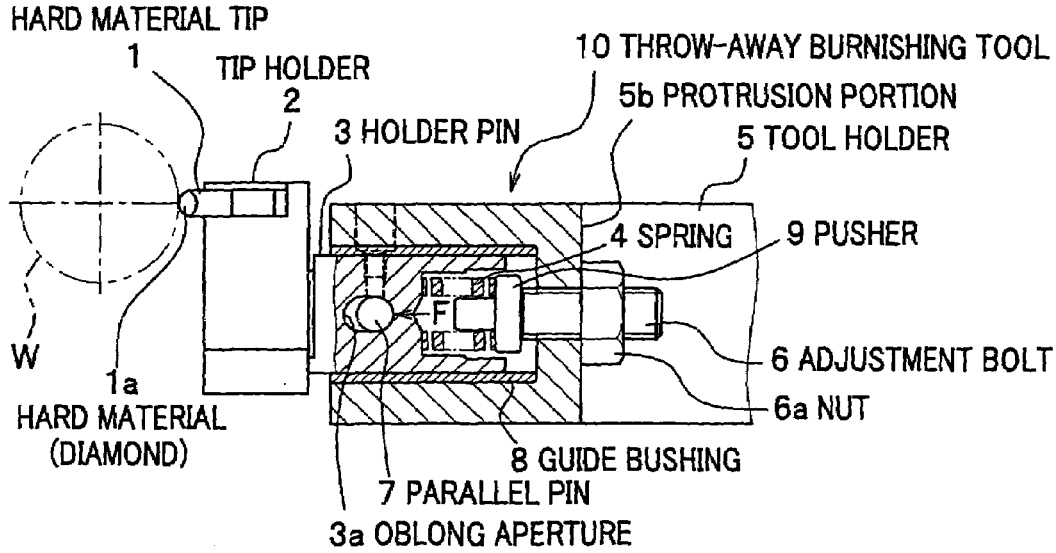

As shown in FIG. 2A, a hard material tip 1 of the throw-away burnishing tool 10 is detachably attached (replaceable) to an attachment seat 2*a* of a tip holder 2 and fixed thereto by a screw 2*b*. The hard material tip 1 is made of diamond or CBN. Diamond, which is the hardest among minerals, may be either an industrial diamond or a natural diamond. CBN, which is the second hardest, is an abbreviation for cubic boron nitride, and this substance does not exist in nature. CBN is not as expensive as an industrial diamond, and is a material available for a cutting work for hardened steel. Because CBN is satisfactory in its heat conductivity, a high-speed machining and an environmentally-friendly dry machining are possible.

In addition to the above, the tip may be made of a material, such as ceramics or cemented carbide, which is high in hardness relative to a to-be-machined material and which has endurance.

Further, the front-end portion of the hard material tip 1 is semi-spherical.

Although a hard material 1*a* of the hard material tip 1 may be CBN 1*a* of a CBN tip 1, description will be given to diamond 1*a* of a diamond tip 1.

A holder pin 3 moves forward and backward directions so that a tip holder 2 connected to the holder pin 3 is moved forward and backward relative to a workpiece W. The holder pin 3 is connected to a side surface of the tip holder 2 at the right angle by a single bolt 2*c*, so that the tip holder 2 and the holder pin 3 are integral to each other.

Providing a semi-spherical front-end portion of the diamond 1*a* makes it possible to use the same single hard material tip 1 for machining in multiple directions such as outer surface, end surface, and inner surface (in a case of having a large diameter).

As shown in FIG. 2A, the diamond tip 1 which has been approximated to the workpiece W indicates an outer-surface machining, while the diamond tip 1 illustrated by chain double-dashed line indicates an end-surface machining.

In the case of end-surface machining, the attaching position of the tool holder 5 may be changed by 90°.

Replacement of the diamond tip 1 can be carried out by the use of a single screw 2*b*. This enables a setup work in a shorter period of time when compared with the conventional throw-away burnishing tool.

An urging means E is a spring 4. Herein, a square coil spring is employed as the urging means E. This is because a square coil spring is more accurate in proportionality between load and displacement than a coil spring having circular cross section.

An urging force adjustment means G includes a pusher 9 provided at an end portion of the spring 4, and an adjustment bolt 6 for urging the pusher 9. The adjustment bolt 6 is screwed in an end portion of the protrusion portion 5*b*.

To be more specific, a cylinder-shaped hole 5*e* is formed in the protrusion portion 5*b*. A guide bushing 8 is fitted into the cylinder-shaped hole 5*e*, and further a holder pin 3 is inserted into the cylinder-shaped hole 5*e* through the guide bushing 8. The spring 4 as an urging means E is internally inserted into a hole of the holder pin 3, and at the end portion of the spring 4 is provided the adjustment bolt 6 as an urging force adjustment means G, which can deflect or displace the spring 4 such that an urging force F is imparted to the holder pin 3 through the pusher 9. The adjustment bolt 6 is fixed by a nut 6*a* for preventing loosening of the adjustment bolt 6. The urging force adjustment mechanism is thereby formed.

Further, the urging force adjustment mechanism is constructed such that the deflection (displacement) amount of the spring 4 is adjusted by the adjustment bolt 6 or the like via the pusher 9, which serves as a base (seat) of the spring 4, from a right-surface side of the holder pin 3.

The holder pin 3 has an oblong aperture 3*a* in the form of a through-hole extending in a direction perpendicular to an axis of the holder pin 3. The oblong aperture 3*a* is formed in parallel to the tip holder 2 when the holder pin 3 is mounted in the protrusion portion 5*b* of the tool holder 5. A parallel pin 7 extends across the cylinder-shaped hole 5*e* and through the oblong aperture 3*a* of the holder pin 3, and both ends of the parallel pin 7 are respectively held at the I-shaped portion 5*a* and the protrusion portion 5*b* of the tool holder 5. Since the parallel pin 7 passes through the oblong aperture 3*a* of the holder pin 3, a movement of the holder pin 3 in the forward and backward directions is guided along the oblong apertures 3*a*. Therefore, the holder pin 3 is movable in the forward and backward directions with respect to the pressing force P. The parallel pin 7 also serves to prevent the holder pin 3 from coming off.

With the construction as described previously, since a point of application of the pressing force P and a sliding surface of the holder pin 3 can be positioned closely to each other, linearity can be maintained in the relationship between displacement of the spring 4 and urging force, which enables an accurate adjustment.

Next, operations of the throw-away burnishing tool 10 for an outside diameter will be described in detail with reference to the drawings. As shown in FIG. 2A, an urging force F obtained from a trial machining is set by the urging means E, which forms part of the urging force adjustment mechanism of the throw-away burnishing tool 10 for an outside diameter. For example, the adjustment bolt 6 has an M6 coarse thread and the pitch thereof is 1.0 mm. Giving the adjustment bolt 6 for one turn allows the spring 4 to be deflected accurately by 1.0 mm. By deflecting the spring 4, for example, from 2.0 mm to 3.0 mm, the urging force can be adjusted as large as 5N (0.51 kgf) from 15N (1.53 kgf) to 20N (2.04 kgf).

Marking or printing may be adapted around the adjustment bolt 6 to provide a scale (divided into 10 or 20 equal parts). This enables more accurate adjustment of the deflection amount, and the pressing force can be changed without changing a machining program.

The throw-away burnishing tool 10 for an outside diameter preferably operates by the following orders.

(1) Setting an urging force F obtained by a trial machining.

(2) Setting an indentation amount at the machine side.

(3) Rotating a workpiece W, and feeding the throw-away burnishing tool 10.

(4) Making the workpiece W approach to the starting end of machining by a rapid traverse, then switching to a machining feed, for carrying out burnishing.

(5) Stopping the machining feed at the machining end, and separating the burnishing tool 10 from the workpiece W.

(6) Returning the throw-away burnishing tool 10 to the original position.

As such, an urging force F close to a necessary machining pressure is applied to the spring 4 in advance of machining, and machining can be carried out with the minimum indentation amount. Therefore, a linear displacement is made possible and an adjustment work in an on-line set-up can be shifted to an off-line set-up, so that the working time for carrying out an adjustment with a deflection from a zero deflection to a set load can be greatly reduced.

For example, when the workpiece W has a hardness of HRC 42, a workpiece is rotated with the spindle of a spindle stock rotating at 100 to 250 m/min, and a machining feed is performed at a cut of 0.2 mm and a feed per one-rotation of 0.05 mm. As a result, owing to the machining feed of the tool holder 5, a pre-machined surface (equivalent to 6 Rmax in a roughness indication) is burnished by the spherical surface of the diamond tip 1, that is, rolled, and is thereby finished into a mirror surface having 1.8 to 3 Rmax.

EMBODIMENT 2

Figure 3A:
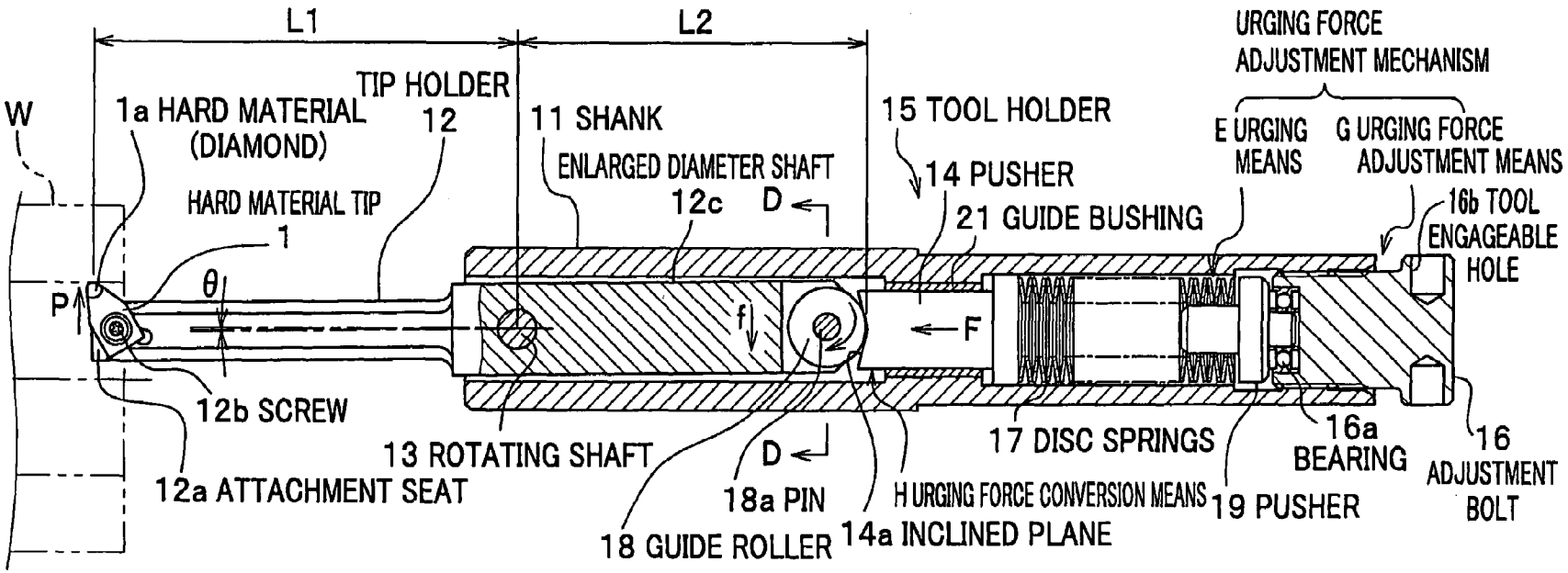
Figure 3B:
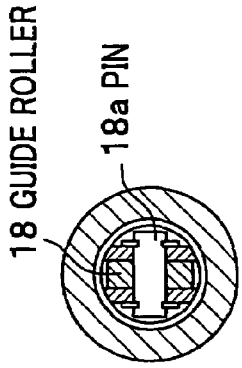
Figure 4A:
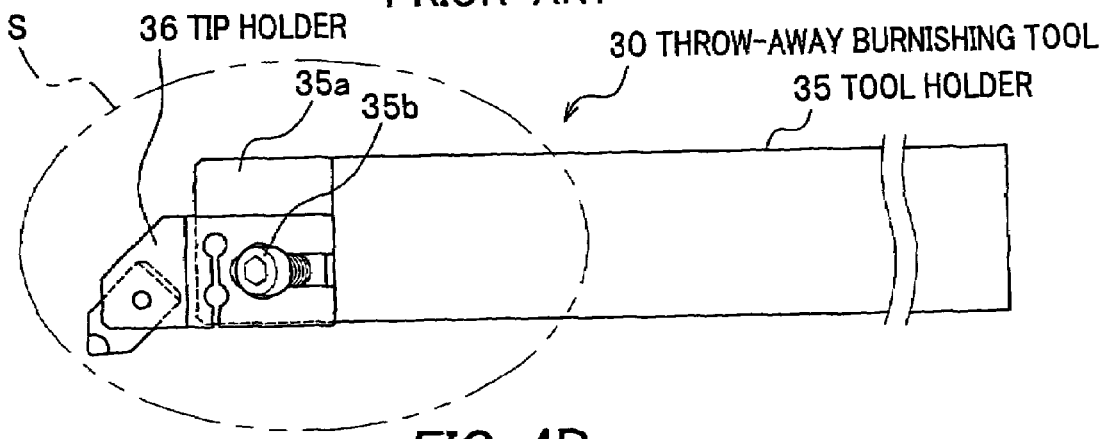
FIG. 4A PRIOR ART
Figure 4B:
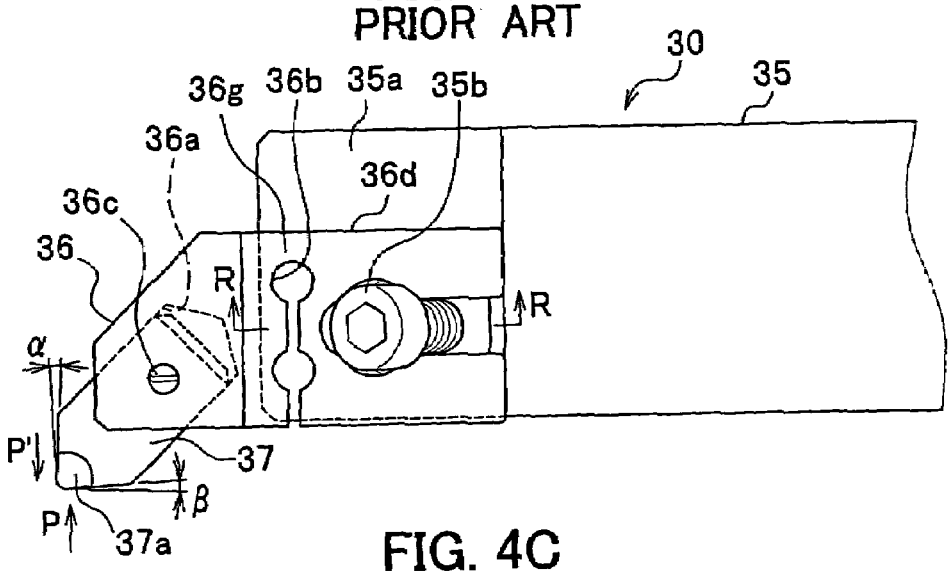
FIG. 4B PRIOR ART
Figure 4C:
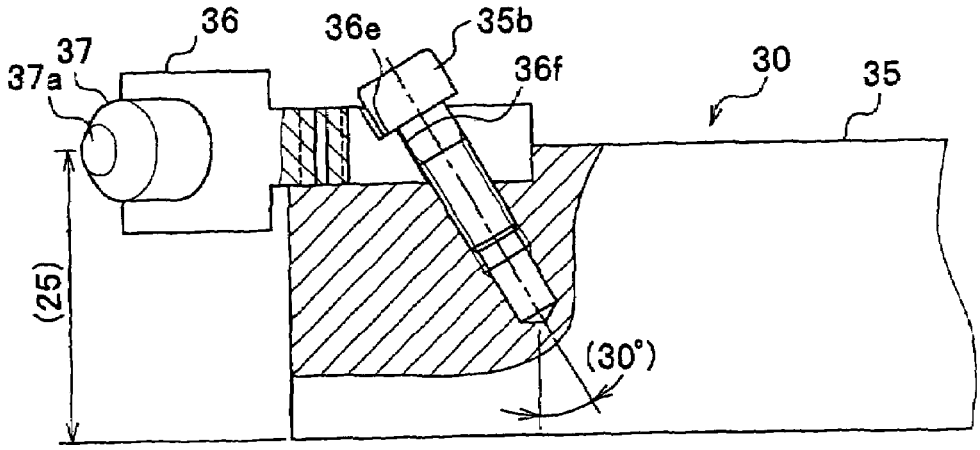
FIG. 4C PRIOR ART

As shown in FIGS. 3A and 3B, a tool holder 15 of a throw-away burnishing tool (hereinafter, simply referred to as a burnishing tool) 20 for burnishing an outer surface of a workpiece includes a cylindrical shank 11 to be mounted on a processing machine, a pusher 14 having an inclined plane 14*a*, and a tip holder 12 rotatable in forward and reverse directions by a pressing force P for pressing the inner peripheral surface of a workpiece W.

The shank 11 is formed to have a pipe shape, and fitted into the central portion of the shank 11 is a guide bushing 21. The pusher 14 is internally inserted into the central portion of the shank 11 through the guide bush 21. An inclined plane 14*a* is provided at an end surface of the pusher 14.

The tip holder 12 is provided with a V-shaped groove. This is for imparting a centering function of the tip holder 12 and restraining a movement of the pusher 14 by the V-shaped groove. Since a large deflection of the tip holder 12 can result in damage, it is necessary to minimize an inclination θ of the tip holder 12 as a measure for preventing a damage of the diamond tip 1. In contrast thereto, the diamond tip 1 is easily damaged if it is fixed without any deflection. It is therefore important to impart a slight spring force (deflection).

The tip holder 12 has an enlarged diameter shaft 12*c* extending from the vicinity of the central portion of the tip holder 12. At the rear-end portion of the enlarged diameter shaft 12*c*, a guide roller 18 is rotatably supported by a pin 18*a*.

An attachment seat 12*a* is provided at the front-end portion of the tip holder 12. The throw-away diamond tip 1 is attached to the attachment seat 12*a* by a screw 12*b* so that replacement of the throw-away diamond tip 1 is readily performed.

The diamond tip 1 has a size of 10×6×3 (length×width×thickness mm). A rod-like industrial diamond whose front-end portion is spherical is embedded in the diamond tip 1 at the center in the thickness direction. The diamond tip 1 can be attached inside out. Further, the diamond tip 1 can be replaced with a spare diamond tip 1 by the screw 12.

A plurality of disc springs 17 are laminated alternately in a face-to-face and back-to-back manner to provide an urging means E. It is more preferable to employ disc springs 17 because of the greater load capacity than coil spring.

An urging force adjustment means G includes: a pusher 19 provided at an end portion of the disc springs 17, an adjustment bolt 16 for urging the pusher 19 via a bearing 16*a*. The adjustment bolt 16 is screwed in the shaft end of the shank 11.

An urging force conversion means H includes an inclined plane 14*a* provided at the end surface of the pusher 14. The inclined lane 14*a* has an inclination angle of 15 to 20° and urges a guide roller 18.

The adjustment bolt 16 has a fine thread and the pitch thereof is 1.0 mm. Giving the adjustment bolt 16 for one turn allows the disc springs 17 to be deflected by 1.0 mm. By deflecting the disc springs 17, for example, from 2.0 mm to 3.0 mm, the urging force can be adjusted as large as 11N from 23N (2.34 kgf) to 34N (3.47 kgf) Therefore, an urging force F of 34N is generated in the axis direction of the shank 11.

Supposing that the distance from the front-end portion of the diamond tip (hard material tip) 1 to the rotating shaft 13 is given as L1 and the distance from the rotating shaft 13 to the guide roller 18 is given as L2, the distance L1 is slightly longer than the distance L2. However, if L1=L2, the pressing force P is converted by the inclined plane 14*a* of the urging force conversion means H to F×sin 15° (=11N(1.12 kgf)) and transmitted to the enlarged diameter shaft 12*c* of the tip holder 12, so that the enlarged diameter shaft 12*c* rotates around the rotating shaft 13 as a fulcrum.

Next, operations of the throw-away burnishing tool 20 for an inside diameter will be described in detail with reference to FIGS. 3A and 3B. As shown in FIG. 3A, an urging force F is generated by the disc springs 17 as the urging means E, which forms part of the urging force adjustment mechanism of the throw-away burnishing tool 20 for an inside diameter, and the adjustment bolt 16 of the urging force adjustment means G. To be more specific, when a tool is inserted into a tool engageable hole(s) 16*b* and the adjustment bolt 16 is turned by the tool to deflect the disc springs 17, an urging force F is generated and adjusted to a value as close as a necessary machining pressure.

The tool holder 15 of the burnishing tool 20 is, for example, fixed to a tool rest of an NC lathe. As shown in FIG. 3A, the diamond tip 1 is come closer to the inner peripheral surface of a workpiece W, and while imparting rotations to the workpiece W, the diamond tip 1 is pressed against the inner peripheral surface of the workpiece W to impart a predetermined pressing force P. The tip holder 12 is then rotated in the opposite direction of the rotating direction f around the rotating shaft 3 as a fulcrum.

Subsequently, for example, when the workpiece W has a hardness of HB 250, a rotating speed of 100 m/min is imparted to the workpiece W, and a feed is performed at a cut of 0.2 mm and a feed per one-rotation of 0.05 mm. As a result, a surface (6 Rmax) processed by a cutting work is burnished by the spherical surface of the diamond 1*a* of the diamond tip 1, and is thereby finished into a mirror surface having 1.8 to 3 Rmax.

While the present invention has been described with reference to preferred embodiments thereof, it is to be understood that various changed and modifications may be made without departing from the spirit of the invention. For example, although the I-shaped portion 5*a* and the protrusion portion 5*b* are integral to each other to provide an L-shaped profile of the tool holder 5, the I-shaped portion 5*a* and the protrusion portion 5*b* may be separate parts so that these two pieces of parts are fixed by bolts an the like to provide an integrated L-shaped profile.

Although the spring of the throw-away burnishing tool 10 for an outside diameter has been described as a square coil spring, it may be a disc spring or other types of springs. The spring of the throw-away burnishing tool 20 for an inside diameter may not be limited to disc springs, and square coil springs or other types of spring may be employed.

Further, as long as providing the same function to guide a movement of the holder pin 3 between the parallel pin 7 and the oblong apertures 3*a*, other construction may be employed such that instead of the parallel pin 7, a keyway or spline may be provided on the holder pin 3 together with a stopper for preventing the holder pin 3 from being come off.

What is claimed is:

1. A throw-away burnishing tool for an outside diameter comprising:

a tool holder having a rectilinear I-shaped portion and a protrusion portion;

a hard material tip detachably attached to a tip holder;

a holder pin connected to the tip holder and accommodated in the protrusion portion of the tool holder, the holder pin having an oblong aperture in the form of a through-hole extending in a direction substantially perpendicular to an axis of the holder pin;

an urging means internally inserted into the holder pin and urging the holder pin;

an urging force adjustment means for adjusting an urging force generated by the urging means; and a parallel pin supported at both ends by the tool holder and passing through the oblong aperture, wherein the parallel pin guides a movement of the holder pin along the oblong aperture.

2. A throw-away burnishing tool for an outside diameter according to claim 1, wherein the I-shaped portion and the protrusion portion are integral to each other to provide an L-shape profile of the tool holder.

3. A throw-away burnishing tool for an outside diameter according to claim 1, wherein the hard material tip is made of diamond or CBN.

4. A throw-away burnishing tool for an inside diameter comprising:

a cylindrical shank to be mounted on a processing machine;

a tip holder received in the shank and rotatable around a rotating shaft by a workpiece pressing force;

an attachment seat provided at a front-end portion of the tip holder;

a throw-away type hard material tip detachably attached to the attachment seat;

a pusher accommodated in the shank and having an end surface;

an urging means provided at the end surface of the pusher and urging the pusher toward the tip holder in an axial direction of the shank;

an urging force adjustment means for adjusting an urging force generated by the urging means;

an urging force conversion means for transmitting the urging force to an enlarged diameter shaft of the tip holder such that a direction of the urging force is converted to a rotating direction of the enlarged diameter shaft, wherein a pressing force is imparted to a workpiece by a rotation of the tip holder in the rotation direction that is caused by the urging force.

* * * * *